United States Patent [19]

Vesamaa

[11] 3,990,348

[45] Nov. 9, 1976

[54] FIREARM HAVING A RELIEF VALVE

[75] Inventor: Erkki Vesamaa, Jyvaskyla, Finland

[73] Assignee: Valmet Oy, Helsinki, Finland

[22] Filed: Apr. 26, 1974

[21] Appl. No.: 464,636

[30] Foreign Application Priority Data

Apr. 27, 1973 Finland ..... 1357/73

[52] U.S. Cl. ..... 89/193; 89/191 A

[51] Int. Cl.[2] ..... F41D 5/08

[58] Field of Search ..... 89/191 A, 193

[56] References Cited

UNITED STATES PATENTS 3,020,807 2/1962 Hailston et al. ..... 89/193

3,420,140 1/1969 Beretta ..... 89/191 A

*Primary Examiner*—Stephen C. Bentley

*Attorney, Agent, or Firm*—Steinberg and Blake

[57] ABSTRACT

A firearm such as a semiautomatic rifle having a gas cylinder which receives gas under pressure upon firing of a round in order to move a gas piston which operates components of the firearm. A relief valve structure communicates with the interior of the gas cylinder for automatically responding by inertia to recoil of the firearm in order to relieve excess gas pressure in the cylinder.

4 Claims, 4 Drawing Figures

FIREARM HAVING A RELIEF VALVE

BACKGROUND OF THE INVENTION

The present invention relates to firearms.

In particular, the present invention relates to firearms such as semiautomatic shotguns utilizing gas under pressure, resulting from firing of a round, in order to operate automatically components of the firearm.

Such firearms have a gas cylinder which receives gas under pressure from the barrel, this gas under pressure acting on a gas piston in the gas cylinder in order to provide the automatic operation. In order to avoid the drawbacks of excessive gas pressure, a relief valve may be provided, and the present invention relates particularly to that part of the firearm which has the relief valve.

Thus, there are known firearms such as semiautomatic shotguns where the gas cylinder-and-piston unit are situated directly on the magazine tube of the gun. For example there are known constructions where the gas cylinder together with the gas piston therein have been mounted to form a continuation of the magazine tube, with the gas piston being movable upon the neck of a separate solid stem member which forms a continuation of the magazine tube. With the design where the gas piston-and-cylinder unit have been placed directly on the magazine tube as well as with the construction where the gas piston-and-cylinder unit forms a continuation of the magazine tube it has been found difficult to accommodate a relief valve for the purpose of equalizing the variations which occur as a result of firing rounds which have charges of various strengths. Thus, the force of the gas under pressure is conventionally utilized to move the gas piston in order to operate a lock which opens a port through which the empty cartridge case is ejected. As a result of charges of various strengths, variations will occur in the force or velocity of the lock return movement, and the purpose of the relief valve is to equalize these variations by automatically reducing the pressure which otherwise would result from a charge of excessive strength.

SUMMARY OF THE INVENTION

It is accordingly a primary object of the present invention to provide for a firearm of the above general type a relief valve structure which avoids the difficulties and drawbacks of the prior art.

Thus it is an object of the present invention to provide a relief valve structure which is of a simple construction and which can be manufactured at relatively low cost.

One of the most important objects of the present invention, however, is to provide a relief valve which will open much faster than has heretofore been possible with conventional relief valves.

In accordance with the invention, the firearm includes a gas cylinder which is fixed to the barrel and communicates therewith to receive gas under pressure therefrom upon firing of a round. A gas piston is slidable in the gas cylinder to respond to the gas under pressure for bringing about automatic operations such as those referred to above. A relief valve means of the invention communicates with the interior of the gas cylinder for responding by inertia upon recoil of the firearm, when a round is fired, in order to automatically open and relieve excess gas under pressure in the gas cylinder. The relief valve means of the invention includes a valve member which is appropriately massive to that as a result of its inertia it lags behind movement of other components upon recoil of the firearm, and it is this inertia which is utilized to provide for opening of one or more apertures through which excess gas under pressure can flow upon recoil of the firearm. In accordance with the invention it is possible to use in addition to the inertia part of the gas pressure itself for contributing to the opening of the relief valve, and the excess gas under pressure can be discharged either to the outer atmosphere or into a space whose volume is reduced by movement of the gas piston under the effect of the gas pressure, so that by transferring some of the excess gas to this latter space the movement of the gas piston will be cushioned achieving in this way a counter-pressure which prevents excessively rapid movement of the gas piston and the components operatively connected therewith to be operated thereby.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
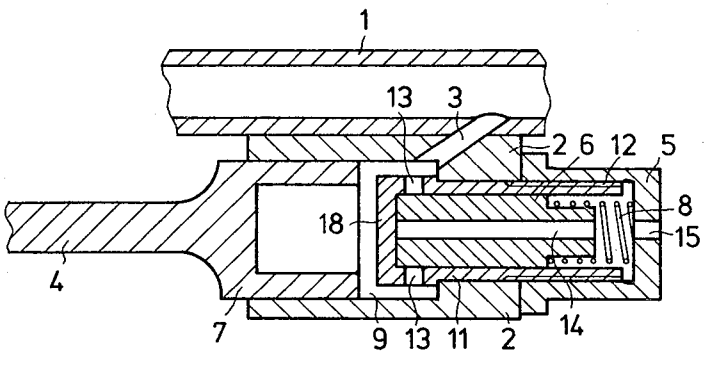
FIG. 1 is a fragmentary sectional elevation of one possible embodiment of the present invention, the plane in which the section of FIG. 1 is taken containing the axis of the barrel as well as the common axis of the gas cylinder and gas piston, FIG. 1 showing a relief valve means of the invention in its closed position.

Referring first to FIG. 1 it will be seen that a gas cylinder 2 is fixed to the barrel 1 of the firearm, this barrel 1 being fragmentarily illustrated. For example the gas cylinder 2 may be brazed to the barrel 1 of the firearm, the axis of the cylinder 2 being parallel to the axis of the barrel 1. A bore 3 is formed through the adjoining walls of the cylinder 2 and barrel 1 so that through the bore 3 the interior of the gas cylinder 2 communicates with the interior of the barrel 1. In this way upon firing of a round the gas under pressure will flow through the bore 3 into the cylinder 2. A gas piston 7 is slidable in the cylinder 2, this gas piston 7 being in the form of a cylinderical body which has an exterior surface in sealed sliding engagement with the interior surface of the cylinder 2. The outer end of the piston 7 is fixed to a piston rod 4, which may be formed integrally with the piston 7, and it is the piston rod 4 which is operatively connected in a known way to components of the firearm for automatically operating these components upon movement of the piston 7 in the cylinder 2 when gas under pressure flows into the latter.

A relief valve means of the invention is provided in order to relieve excess gas under pressure in the cylinder 2. This relief valve means includes a valve cylinder 11 which is fixed to the gas cylinder 2 and extends into the interior thereof. For this purpose the valve cylinder 11 extends fluid-tightly through an opening formed in the right end wall of the cylinder 2, as viewed in FIG. 1, the valve cylinder 11 having a shoulder which engages the inner surface of this end wall of the cylinder 2. At its part which projects to the exterior of the cylinder 2, the valve cylinder 11 has an exterior thread 12 cooperating with an interior thread of a closure cap 5 which forms the outer end of the valve cylinder 11. This cap 5 is tightly threaded onto the threads 12 so as to maintain the valve cylinder 11 fixed with respect to the gas cylinder 2 in the position indicated in FIG. 1.

Within the valve cylinder 11 is situated an inertia valve member 6 of appropriate mass, this valve member 6 providing the relief valve operation in a manner described below. The inertia valve member 6 is freely slidable within the valve cylinder 11, with the valve member 6, cylinder 11, gas cylinder 2, and gas piston 7 all having a common axis parallel to the axis of the barrel 1. Because of its appropriate relatively large mass, the inertia valve member 6 will lag behind the valve cylinder 11 when the latter moves with the structure to which it is connected upon recoil of the firearm when a round is fired. Thus, upon recoil the barrel 1 together with the gas cylinder 2 will move to the left, as viewed in FIG. 1, while the valve member 6, because of its inertia, will initially remain substantially stationary so that the valve cylinder 11 displaces itself to the left, as viewed in FIG. 1, with respect to the valve member 6, which remains stationary due to inertia, upon recoil of the firearm. As will be apparent from the description below, after the initial movement of the cylinder 11 with respect to the valve member 6, that latter can be acted upon by the excess gas under pressure to continue the opening movement of the relief valve means of the invention. Thus, the relief valve means of the invention responds to the presence of excess gas under pressure in the hollow interior 9 of the gas cylinder 2 in order to automatically relieve the excess pressure.

Figure 2:
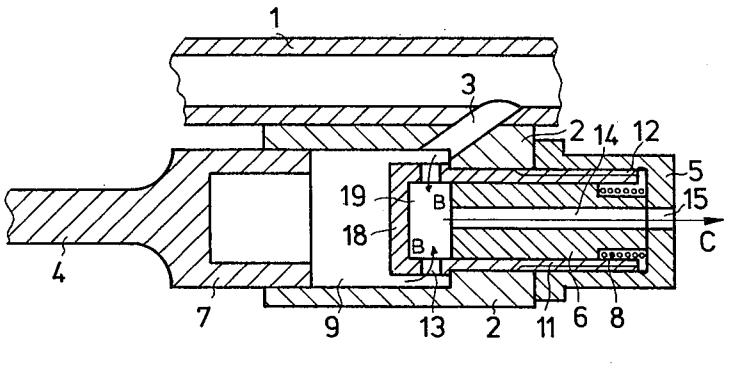
FIG. 2 illustrates the same structure as FIG. 1 but shows the position which the parts take upon opening of the relief valve means of the present invention.

The valve cylinder 11 is formed adjacent its inner end 18 which is in the interior of the gas cylinder 2 with at least one opening 13, although a plurality of these openings are illustrated. Thus, upon recoil of the firearm the structure will assume a position as illustrated in FIG. 2, enabling the excess gas under pressure in the space 9 to flow through the openings 13, in the direction indicated by the arrows B, into the space 19 which forms between the end 18 of the cylinder 11 and the left end of the valve member 6, as viewed in FIGS. 1 and 2. In the closed position of the relief valve, the valve member 6 assumes the position with respect to cylinder 11 which is illustrated in FIG. 1 where the valve member 6 extends across and closed the openings 13. Due to the inertia of the valve member 6 upon recoil of the firearm the openings 13 will become at least partially uncovered so that the excess gas under pressure can enter into the space 19, and once this operation takes place the gas pressure itself in the space 19 can contribute to the further opening movement of the valve member 6.

The valve cylinder 11 is formed adjacent its outer end, formed by the cap 5, with a second opening 15 situated at the exterior of the cylinder 2, and the valve member 6 is formed with a passage 14 which communicates with this second opening 15 as well as with the openings 13 upon opening of the relief valve means of the invention. Thus in the illustrated example the passage 14 is in the form of a bore which extends axially through the valve member 6 with the opening 15 being centrally situated coaxially with the bore 14 so that the excess gas under pressure flowing into the space 19 can continue to flow through the passage 14 and out through the opening 15 to the outer atmosphere, as indicated by the arrow C in FIG. 2.

In this way discharge of overpressure takes place. FIG. 2 illustrates the condition when a charge which is more potent than an average charge has been fired, so that the gas flows through the apertures 13 into the space 19 and through the passage 14 and opening 15 into the free atmosphere. In this way the relief valve means has discharged excessive pressure and reduced the force acting on the gas piston 7 so that the latter is not displaced with an undesirably large force.

Figure 3:
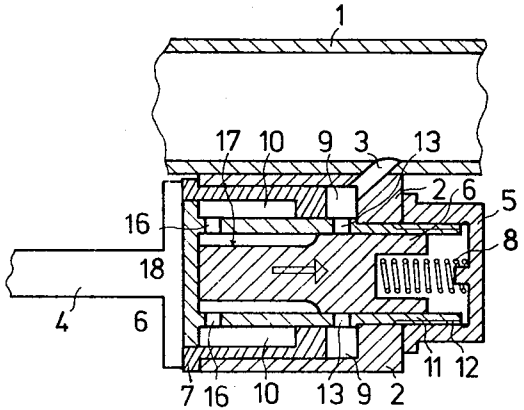
FIG. 3 is a fragmentary sectional elevation, also taken in a plane which contains the axis of the barrel and the common axis of the gas cylinder and gas piston, FIG. 3 illustrating a different embodiment of the present invention with the relief valve means of the present invention being shown in FIG. 3 in its closed position.
Figure 4:
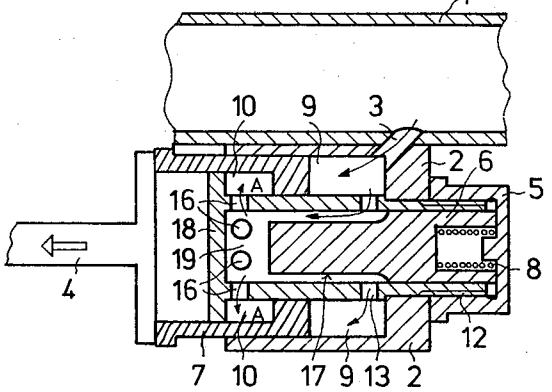
FIG. 4 shows the position which the parts of FIG. 3 take upon opening of the relief valve means of the present invention.

The embodiment of FIGS. 3 and 4 also includes a gas cylinder 2 fixed to the barrel 1 and communicating therewith through the common bore 3. The valve cylinder 11 also extends into the interior space 9 of the gas cylinder 2 and is fixed to the right end wall of the latter, as viewed in FIG. 3, by the cap 5 which is threaded onto the cylindrical wall of the cylinder 11. It will be noted, however, that in the embodiment of FIG. 3 the exterior end wall of the valve cylinder is not formed with an opening. In both embodiments of the invention the exterior end wall of the gas cylinder engages the right end of a spring means 8 in the form of a coil spring which presses on the inertia valve member 6 to urge the latter to the left to its closed position. In the embodiment of FIG. 3, however, the inertia valve member 6 is not formed with a passage taking the form of an axial bore. Instead the inertia valve member 6 of FIG. 3 has an elongated portion 17 of reduced diameter which defines a space with the inner surface of the cylinder 11, and it is this space which forms the passage through which the excess gas under pressure flows from the space 9. In the case of FIG. 3 the cylinder 11 is formed with the openings 13 at approximately the same location as in the case of FIG. 1, but in the case of FIG. 3 the cylinder 11 extends through a considerably greater distance to the left beyond the openings 13.

In the embodiment illustrated in FIG. 3, the inner end 18 of the valve cylinder 11 has an outwardly directed flange which is surrounded by the inner surface of the cylindrical hollow piston 7. Thus in the case of FIG. 3 the piston 7 has a sealed sliding contact not only with the inner surface of the gas cylinder 2, at the outer surface of the piston 7, but also with the outer periphery of the flange at the end wall 18 of the cylinder 11, at the inner surface of the piston 7. At its innermost end, the piston 7 of FIG. 3 has an inwardly directed flange which has a fluid-tight sliding engagement with the exterior surface of the cylinder 11 between the end 18 thereof and the openings 13, so that in this way between the flanges of the cylinder 11 and the piston 7 there is formed a space 10 which communicates with at least one opening 16 formed in the cylinder 11 adjacent the end 18 thereof, a plurality of these openings 16 being shown in the illustrated example. The remainder of the valve member 6 which is not provided with the reduced diameter portion 17 closes the openings 13 in the closed position of the relief valve means which is illustrated in FIG. 3.

With this embodiment of the invention, upon recoil of the firearm the barrel 1 together with the cylinders 2 and 11 will move to the left, as viewed in FIG. 3, while the valve member 6 due to its inertia will lag behind, thus causing the openings 13 to become displaced to the left with respect to the valve member 6 to an extent sufficient for these openings 13 to become uncovered so that excess gas under pressure in the space 9 will flow through the openings 13 along the passage formed by the reduced diameter portion 17 and then in the direction of the arrows A through the openings 16 into the space 10. Of course, this excess gas under pressure which reaches the interior of the valve cylinder 11 will act on the shoulder formed between the reduced diameter portion 17 and the remainder of the valve member 6 so as to contribute to the opening movement thereof once the initial increment of opening movement resulting from inertia is provided as described above. In addition with the embodiment of FIGS. 3 and 4, the gas under pressure which flows into the space 10 will cushion the movement of the piston 7 to the left, as viewed in FIGS. 3 and 4, so that in this way the excess gas under pressure is directly utilized to reduce the force acting on the piston 7 to displace the latter. Thus, the gas under pressure which enters into the space 10 in a manner described above acts as a counterpressure to the movement of the piston 7 by the gas under pressure in the space 9. The stiffness selected for the springs 8 in both embodiments is such that the recoil of the firearm suffices to bring about an automatic opening of the relief valve. In addition, however, the spring 8 in both embodiments serves to position the valve member 6 in its closed position engaging the inner end 18 of the valve cylinder 11.

FIG. 4 illustrates, in the same way as FIG. 2, the operation resulting from the firing of a charge of more than average potency. While in the case of FIGS. 1 and 2 the attenuation of gas pressure is brought about by discharge to the outer atmosphere, in the case of FIGS. 3 and 4 the attenuation is exclusively based on utilization of the counterpressure resulting from the transfer of the excessive gas under pressure into the space 10 which is defined between the piston 7 and the cylinder 11 as well as between their flanges. In this embodiment there is defined between the outer flange at the end 18 of the cylinder 11 and the inner surface of the cylinder 7 a gap which is sufficient to permit gas to escape through this gap into the space in the hollow piston 7 to the left of the wall 18, as viewed in FIG. 4.

In a manner which is known, the movement of the piston 7 to the left will through the piston rod 4 push the lock return sleeve and the locking lugs into their open position where the port through which the empty cartridge case is ejected becomes uncovered. The components 4 and 7 continue to move with the lock structure up to the end of the opening movement thereof. Then the lock structure is returned to close the cartridge case ejection port and to return the locking lugs to their locked position, the piston 7 is returned to the position indicated in FIGS. 1 and 3, so that the parts are now in their starting position for firing a new round.

As is apparent from the above description and the drawings, with the present invention use is made of the recoil of the firearm in that the relief valve member has a suitably large mass which provides the inertia effect achieving the lagging of the inertia valve member with respect to the valve cylinder and gas cylinder which are fixed with respect to the firearm so that when the latter bounces rearwardly upon recoil the relief valve means will automatically open. It is this displacement of the valve cylinder with respect to the valve member 6 which is utilized to open the relief valve so that the overpressure can be reduced by escape of gas to the outer atmosphere in the case of FIGS. 1 and 2 or to the rear face of the gas piston to act as a counterpressure in the case of FIGS. 3 and 4.

A particular advantage which is achieved with the structure of the invention is that the recoilcontrolled relief valve acts faster than conventional valves which respond only to a build-up of overpressure. In addition, the utilization of recoil is highly appropriate for control of the relief valve in view of the fact that in proportion to the pressure which acts on the gas piston the recoil will be stronger or weaker as the charge with which the round is fired is stronger or weaker, so that the desired operation with charges of greater than average potency is assured with the structure of the invention.

What is claimed is:

1. In a firearm, a barrel, a gas cylinder fixed to said barrel and communicating with the interior thereof for receiving gas under pressure therefrom upon firing of a round, a gas piston slidable in said gas cylinder to be displaced by gas under pressure received in said cylinder for operating components of the firearm, and relief valve means carried by said gas cylinder for responding automatically by inertia to recoil of the firearm upon firing of a round for automatically relieving excess pressure in said cylinder, said relief valve means including a valve cylinder fixedly carried by and extending at least partly into said gas cylinder, said valve cylinder being formed in the interior of said gas cylinder with at least one opening for providing communication between the interior of said gas cylinder and the interior of said valve cylinder, and an inertia valve member situated in said valve cylinder for free sliding movement therein and normally assuming a closed position closing said opening in said valve cylinder, said inertia valve member responding to recoil of the firearm for lagging behind said valve cylinder which moves with the firearm during recoil movement thereof for uncovering said opening in said valve cylinder so that excess gas pressure can be relieved by flow of gas from said gas cylinder into said valve cylinder through said opening thereof, said inertia valve member having a surface engaged by the gas under pressure which enters into said valve cylinder after initial movement of said valve cylinder with respect to said valve member due to inertia, said surface of said valve member being acted upon by the gas under pressure to continue the opening movement of said valve member so that the latter opens both by inertia as well as by the force of the gas under pressure, said valve cylinder having in the interior of said gas cylinder an inner end provided with an outwardly extending flange surrounded by an inner surface of said gas piston, said gas cylinder communicating with said barrel at a location distant from said flange and said gas piston having a hollow cylindrical portion terminating between said location and said flange in an inwardly directed flange slidably engaging the exterior of said valve cylinder with said hollow cylindrical portion of said piston defining a space with said valve cylinder between said flanges, said opening of said valve cylinder being situated between said inwardly directed flange of said piston and said location and said valve cylinder being formed with at least one additional opening providing communication between said space and the interior of said valve cylinder, said valve member being formed with a passage providing communication between both of said openings after said valve cylinder is displaced with respect to said valve member upon recoil of the firearm so that excess gas under pressure will flow not only into said gas cylinder to act on said inwardly directed flange of said gas piston for displacing the latter with respect to said gas cylinder but also through said openings into said space between said flanges for cushioning the movement of said gas piston in said gas cylinder along said valve cylinder.

2. The combination of claim 1 and wherein said passage is formed by an elongated portion of said valve member which is of a reduced diameter with respect to the remainder of said valve member, said remainder of said valve member closing said opening of said valve cylinder which is between said inwardly directed flange of said gas piston and said location when said valve member is in its closed position.

3. The combination of claim 2 and wherein said valve member, valve cylinder, gas cylinder and gas piston all have a common axis parallel to said barrel.

4. The combination of claim 3 and wherein a spring means is situated in said valve cylinder and acts on said valve member for releasably holding the latter in its closed position.

* * * * *